US012270178B2

(12) United States Patent
Brevet et al.

(10) Patent No.: US 12,270,178 B2
(45) Date of Patent: Apr. 8, 2025

(54) WORKING MACHINE AND ASSEMBLY COMPRISING SUCH A MACHINE

(71) Applicant: MANITOU BF, Ancenis (FR)

(72) Inventors: Sylvain Brevet, Ancenis (FR); Mathieu Danet, Ancenis (FR)

(73) Assignee: MANITOU BF, Ancenis (FR)

( * ) Notice: Subject to any disclaimer, the term of this patent is extended or adjusted under 35 U.S.C. 154(b) by 0 days.

(21) Appl. No.: 17/767,874

(22) PCT Filed: Oct. 12, 2020

(86) PCT No.: PCT/FR2020/051794

§ 371 (c)(1),
(2) Date: Apr. 8, 2022

(87) PCT Pub. No.: WO2021/074512

PCT Pub. Date: Apr. 22, 2021

(65) Prior Publication Data

US 2024/0084544 A1 Mar. 14, 2024

(30) Foreign Application Priority Data

Oct. 17, 2019 (FR) ..... 19 11584

(51) Int. Cl.
*E02F 3/36* (2006.01)

(52) U.S. Cl.
CPC ..... *E02F 3/3636* (2013.01); *E02F 3/3686* (2013.01)

(58) Field of Classification Search
CPC ..... E02F 3/3636
See application file for complete search history.

(56) References Cited

U.S. PATENT DOCUMENTS

| | | | | |
|---|---|---|---|---|
| 3,874,533 | A * | 4/1975 | Montgomery | E02F 3/3631 414/723 |
| 4,509,768 | A | 4/1985 | Haug | |
| 7,290,977 | B2 * | 11/2007 | Albright | E02F 9/2271 403/321 |
| 7,832,127 | B2 * | 11/2010 | Hill | E02F 3/3631 37/417 |
| 8,024,875 | B2 * | 9/2011 | Wetzel | E02F 3/964 37/468 |
| 9,167,739 | B2 * | 10/2015 | Borghi | E02F 3/3631 |
| 10,883,244 | B2 * | 1/2021 | Ackermann | E02F 3/364 |
| 2013/0011180 | A1 | 1/2013 | Borghi | |

OTHER PUBLICATIONS

International Search Report dated Jan. 11, 2021.

* cited by examiner

*Primary Examiner* — Gerald McClain
(74) *Attorney, Agent, or Firm* — IPSILON USA, LLP

(57) ABSTRACT

A working machine (1) includes a mobile chassis (2) that can move on a surface of the ground, a lifting arm (3) mounted on the chassis (2) to pivot about a horizontal axis (4) for a raising and lowering movement of the arm (3), and an accessory coupler (5) that can be secured to the free end of the arm (3) by a pivot link (6) with axis parallel to the axis (4) for pivoting the arm (3) with respect to the chassis (2). The coupler (5) has a plate (7) having a rear face (8) facing the arm (3) equipped with said pivot link (6) of the coupler (5) to the arm (3) and an opposite front face (9). The plate (7) is provided with a through-opening (10) and at least one part (61) of the pivot link (6) connecting the coupler (5) to the arm (3) is arranged facing the opening (10).

11 Claims, 7 Drawing Sheets

WORKING MACHINE AND ASSEMBLY COMPRISING SUCH A MACHINE

RELATED APPLICATION

This application is a National Phase of PCT/FR2020/051794 filed on Oct. 12, 2020, which claims the benefit of priority from French Patent Application No. 19 11584, filed on Oct. 17, 2019, the entirety of which are incorporated by reference.

Field of the Invention

The present invention relates to a working machine and to an assembly comprising such a working machine and an accessory that can be coupled to the coupler of said machine.

It relates in particular to a working machine comprising a wheeled or tracked frame which can be displaced on the ground surface, a lifting arm mounted on the frame so as to be able to pivot about a horizontal axis for an upward and downward displacement of the arm, and an accessory coupler which can be secured to the free end of the arm by way of a pivot connection having an axis parallel to the pivoting axis of the arm relative to the frame.

Description of Related Art

It is conventional to use a coupler forming an interface between an accessory, such as a hopper, or bucket, a blade, a sweeper or the like, and the arm of a working machine to fix the accessory to the arm. It is often necessary to attach an adapter to the coupler to allow certain accessories to be received. A solution is therefore sought that makes it possible to dispense with the presence of an adapter without adversely affecting the versatility of the coupler.

OBJECTS AND SUMMARY

An object of the invention is to provide a working machine having a design which allows the coupler to have great versatility without adversely affecting its simplicity.

To that end, the subject of the invention is a working machine comprising a movable frame which can be displaced on the ground surface, a lifting arm mounted on the frame so as to be able to pivot about an axis, referred to as horizontal axis, for an upward and downward displacement of the arm, and an accessory coupler which can be secured to the free end of the arm by way of a pivot connection having an axis parallel to the pivoting axis of the arm relative to the frame, characterized in that said coupler comprises a plate having a face, referred to as rear face, that faces the arm and is equipped with at least a part of said pivot connection connecting the coupler to the arm and an opposite face, referred to as front face, in that the plate is provided with a through-opening, and in that that part of said pivot connection connecting the coupler to the arm with which the rear face of the plate is equipped is arranged facing said opening. The presence of a through-opening allows an accessory arranged so as to at least partially bear against the front face side of the plate to be able to protrude through said opening toward the arm. Thus, the through-opening makes it possible to manage the possible bulk of the accessory. Furthermore, such a design allows the production of a lightweight coupler and a limited offset of the accessory.

According to one embodiment of the invention, said through-opening, delimited by edges, is an opening referred to as being upwardly open in the upright state of the plate, one of the delimiting edges of said opening, forming the upper edge of said opening in the upright state of the plate, being an open edge. Again, this arrangement makes it possible to have a large clearance at the through-opening.

According to one embodiment of the invention, the plate in the upright state has the overall shape of a U, the space left free between the branches of the U forming said through-opening. The through opening can thus occupy a central position.

According to one embodiment of the invention, the coupler is provided with a reinforcing element extending from the rear face side of the plate. This reinforcing element prevents deformation of the plate without adversely affecting the ways in which the accessory can be coupled to the coupler.

According to one embodiment of the invention, the reinforcing element, which comprises a tubular element, connects the branches of the U to one another, at the free end of the branches of the U. This prevents a risk of separation or deformation of the branches of the U.

According to one embodiment of the invention, the tubular element of the reinforcing element has a circular section. Preferably, the tubular element of the reinforcing element is formed by a profile attached and welded to said plate via two end flanges connecting the profile to the back, or rear face, of the plate. Each end flange bearing by way of its edge against the rear face of the plate is interposed between two gusset plates arranged on either side of the flange and coupling the flange to the rear face of the platform.

According to one embodiment of the invention, the plate is provided, on the rear face side, with two aligned profiles, said profiles extending parallel to the pivot axis of the pivot connection connecting the coupler to the arm, on either side of said through-opening in the coupler. These two profiles allow an interlocking engagement with complementary recessed parts of the accessory.

Preferably, each profile is an L-shaped bracket applied to the rear face of the plate.

According to one embodiment of the invention, the coupler comprises, for the purpose of coupling an accessory to the coupler, on the rear face side of the plate, two locking pins, preferably parallel, extending transversely, preferably orthogonally, to the axis of the pivot connection connecting the coupler to the arm, each of said locking pins being equipped with a handle for driving said locking pin in translation so as to displace said locking pin between an unlocked position and a locked position and with a spring for returning said locking pin to the locked position. The locking pins thus make it possible to lock the interlocking connection between the coupler and the accessory.

According to one embodiment of the invention, the plate of the coupler is delimited by edges and the through-opening in the coupler is an opening extending centrally between two opposite edges of said plate. In other words, the plate and the through-opening are each delimited by edges, two opposite edges of the opening respectively extending equidistantly from two opposite edges of the plate.

According to one embodiment, that part of said pivot connection connecting the coupler to the arm with which the rear face of the plate is equipped and which is arranged facing said opening forms a one-piece assembly with said plate. In this way, that part of the pivot connection connecting the coupler to the arm with which the rear face of the plate is equipped forms with said plate an assembly that is incapable of being dismounted.

According to one embodiment of the invention, that part of said pivot connection connecting the coupler to the arm with which the rear face of the plate is equipped and which is arranged facing said opening is in the form of a sleeve delimiting a through-passage.

According to one embodiment of the invention, the arm is provided with a ram which can be coupled to the coupler, on the rear face side of the plate of the coupler, by way of a pivoting connection having an axis parallel to the axis of the pivot connection connecting the arm to the coupler for the purpose of driving the plate in rotation about the pivot axis of the pivot connection connecting the coupler to the arm in the actuated state of said ram. The plate is therefore a plate that can be oriented using said ram.

Another subject of the invention is an assembly comprising a working machine and an accessory, characterized in that the working machine is in accordance with that described above.

BRIEF DESCRIPTION OF THE DRAWINGS

The invention will be clearly understood on reading the following description of exemplary embodiments, with reference to the appended drawings, in which.

DETAILED DESCRIPTION

Figure 1:
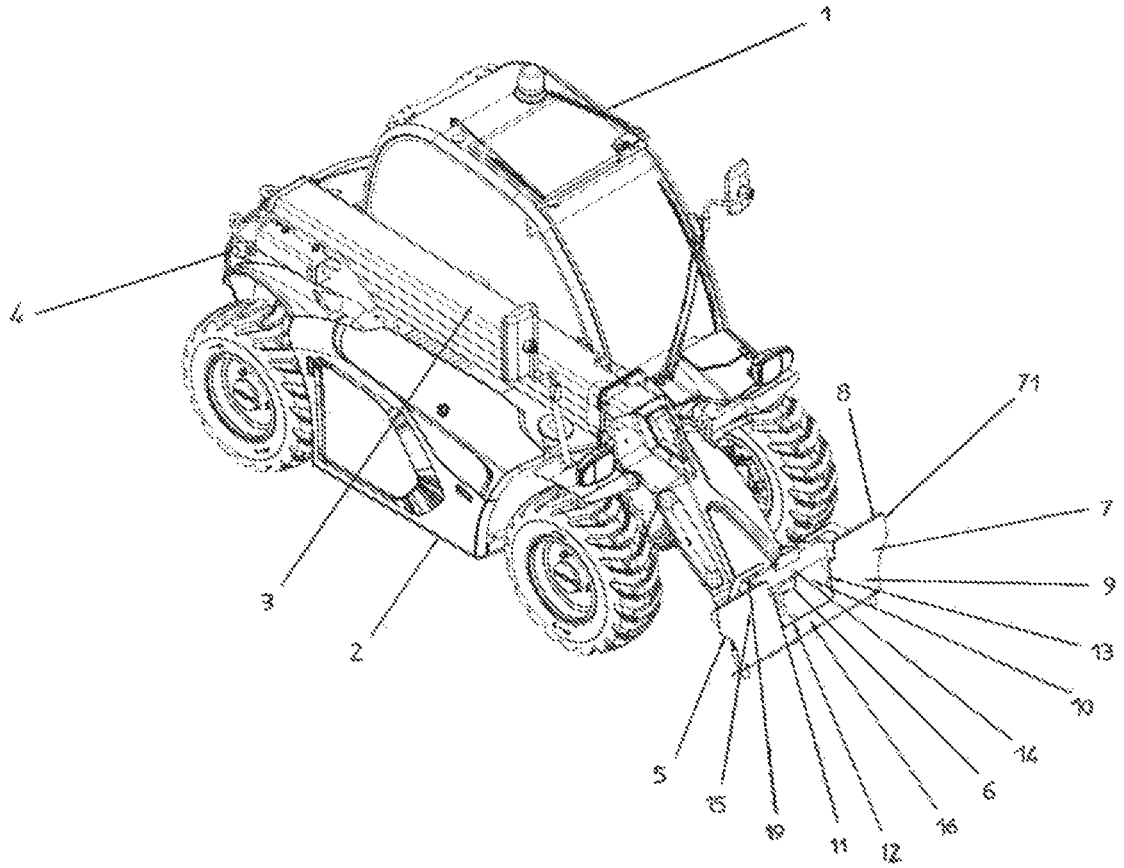
FIG. 1 shows a perspective view of a working machine in accordance with the invention.
Figure 2:
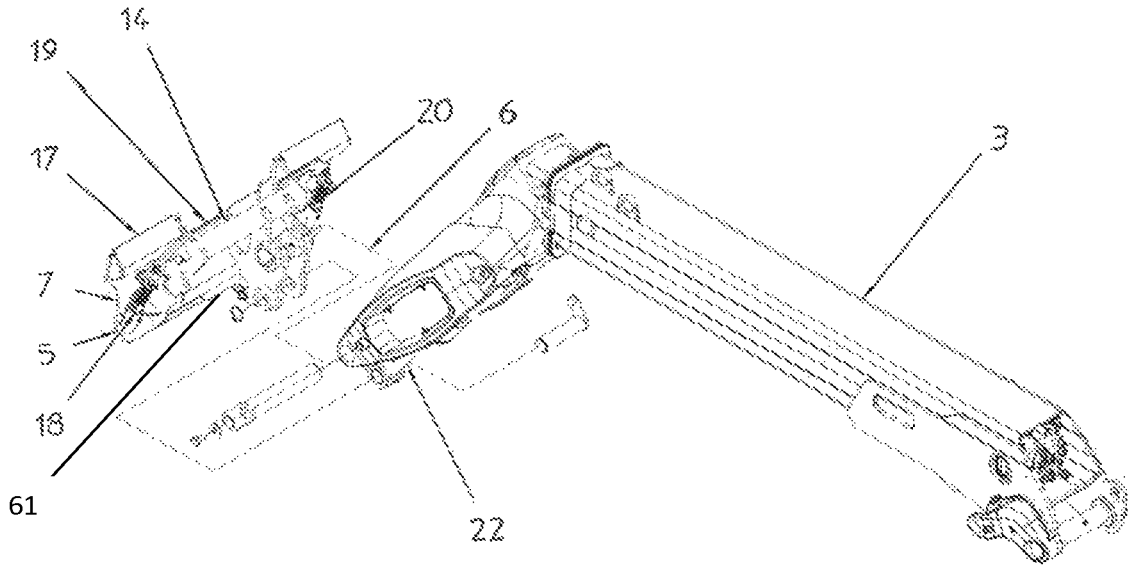
FIG. 2 shows a view of an arm of a working machine in the course of being coupled to a coupler.
Figure 3:
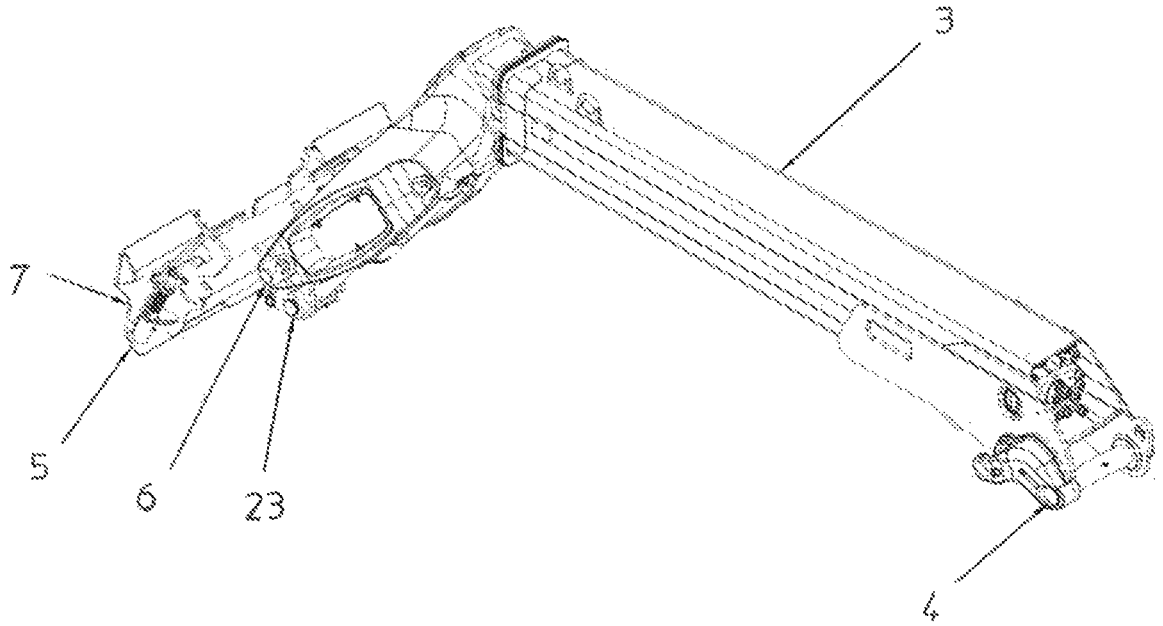
FIG. 3 shows a view of the arm of FIG. 2 in the state in which it is coupled to the coupler in a first orientation of the plate.

As mentioned above, the working machine 1, which is an object of the invention, comprises a movable frame 2 which can be displaced on the ground surface via wheels as in the example shown or via tracks.

This frame 2 is surmounted by a lifting arm 3 that is coupled pivotably to the frame 2. This lifting arm 3 is mounted on the frame 2 so as to be able to pivot about an axis 4, referred to as horizontal axis, for an upward and downward displacement of the arm 3.

The working machine 1 also comprises an accessory coupler 5 which can be secured to the free end of the arm 3 by way of a pivot connection 6 having an axis parallel to the pivoting axis 4 of the arm 3 relative to the frame 2.

The accessory 30 with which the coupler 5 can be coupled may take many forms depending on the work to be carried out by the machine 1. Thus, this accessory 30 may be, for example, a bucket in the case of a load-handling machine, a blade in the case of a snowplow-type machine, a claw, a sweeper or the like without departing from the scope of the invention.

This coupler 5 comprises a plate 7 having a face 8, referred to as rear face, that faces the arm 3 and is equipped with a part 61 of the pivot connection 6 connecting the coupler 5 to the arm 3 and an opposite face 9, referred to as front face. Another part of the pivot connection 6 connecting the coupler 5 to the arm 3 is borne by the arm 3 and a pin allows said parts of the pivot connection 6 to be held together in the coupled state. The pivot connection 6 therefore comprises a part 61 borne by the plate 7 and a part borne by the arm 3.

The accessory 30 is intended to at least partially bear against the front face 9 of the plate 7 in the state in which it is coupled to said plate 7. To allow an orientation of the plate 7 of the coupler 5 in the state in which the coupler 5 is secured to the arm 3 by way of the pivot connection 6, the arm 3 is provided with a ram 22 which can be coupled to the coupler 5 on the rear face side 8 of the plate 7 of the coupler 5 by way of a pivoting connection 23 having an axis parallel to the axis of the pivot connection 6 connecting the arm to the coupler 5. This ram 22 allows the plate 7 to be driven in rotation about the axis of the pivot connection 6 connecting the coupler 5 to the arm 3 in the actuated state of the ram 22.

Figure 4:
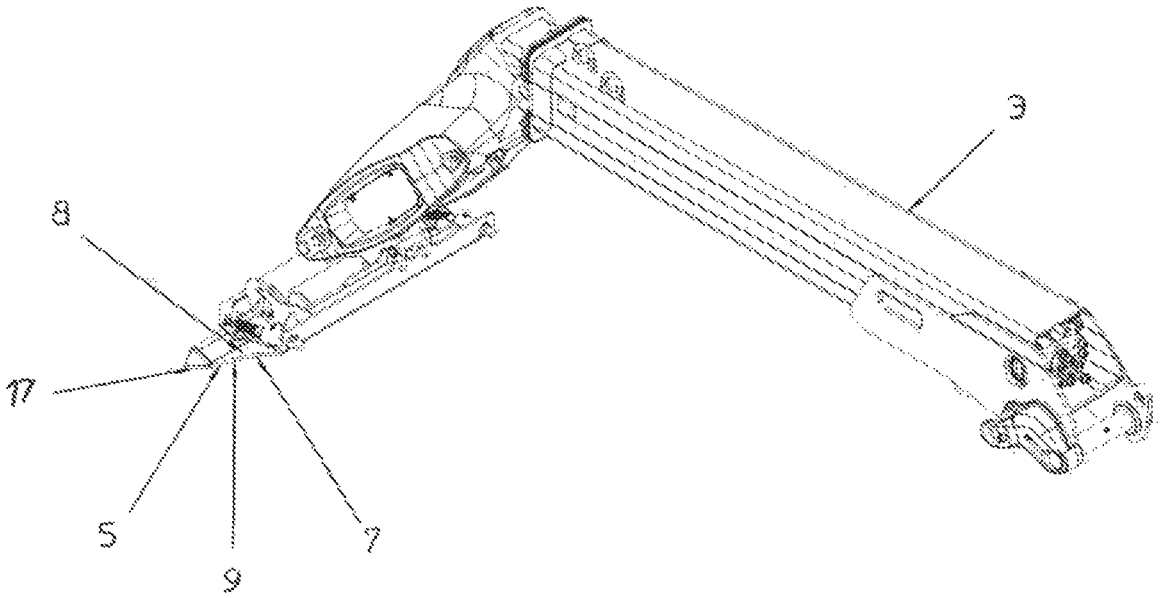
FIG. 4 shows a view of the arm of FIG. 2 in the state in which it is coupled to the coupler in a second orientation of the plate.
Figure 5:
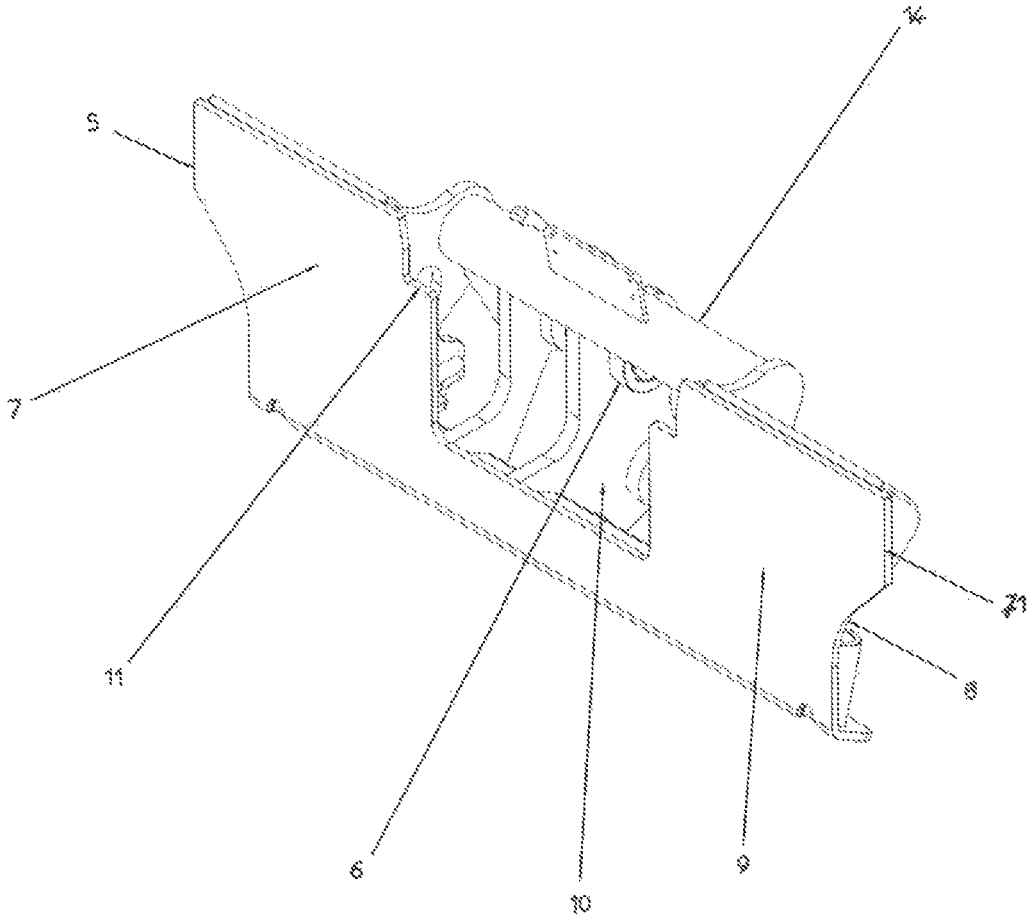
FIG. 5 shows a partial perspective view of a coupler.
Figure 6:
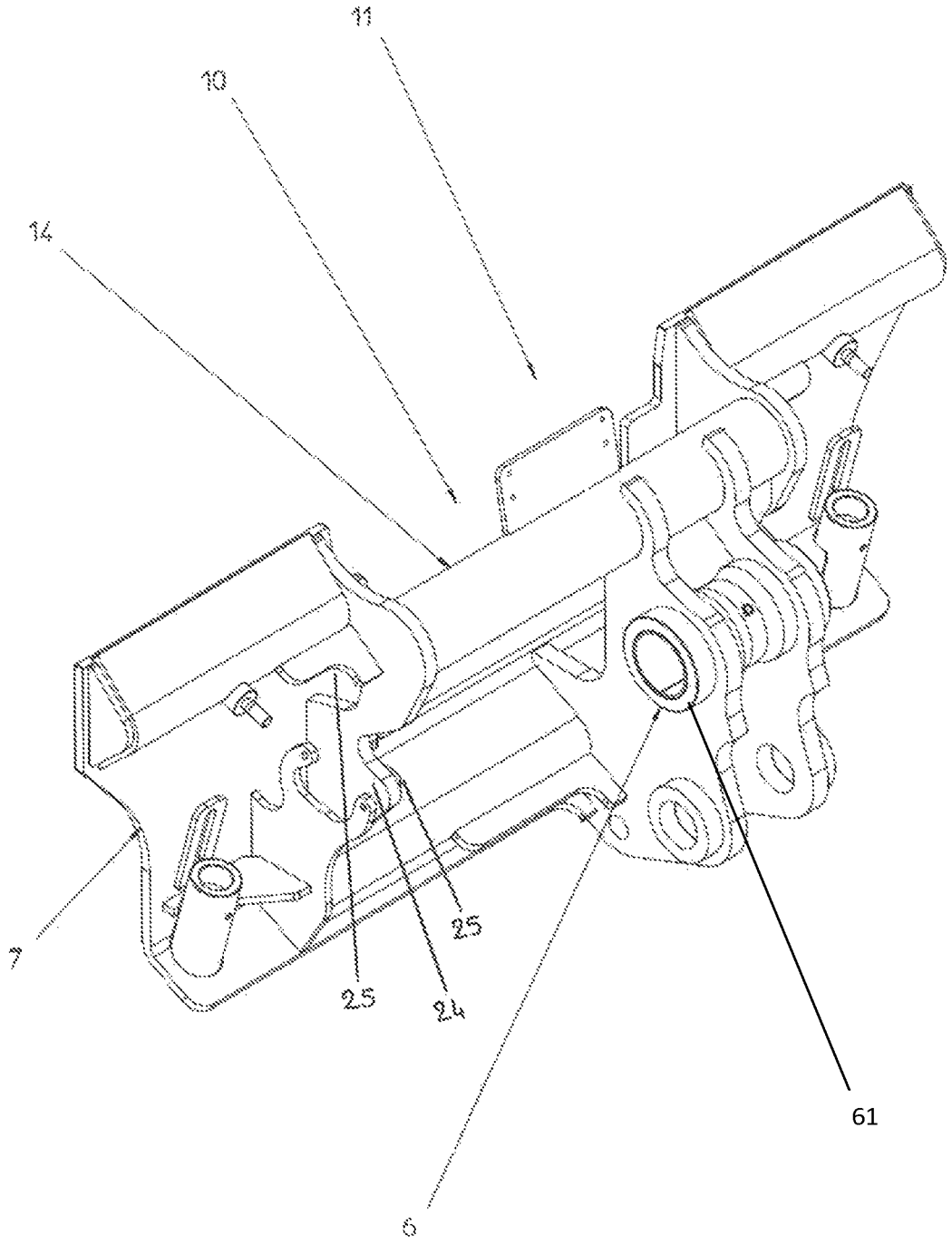
FIG. 6 shows a partial perspective view of a coupler from another angle.
Figure 7:
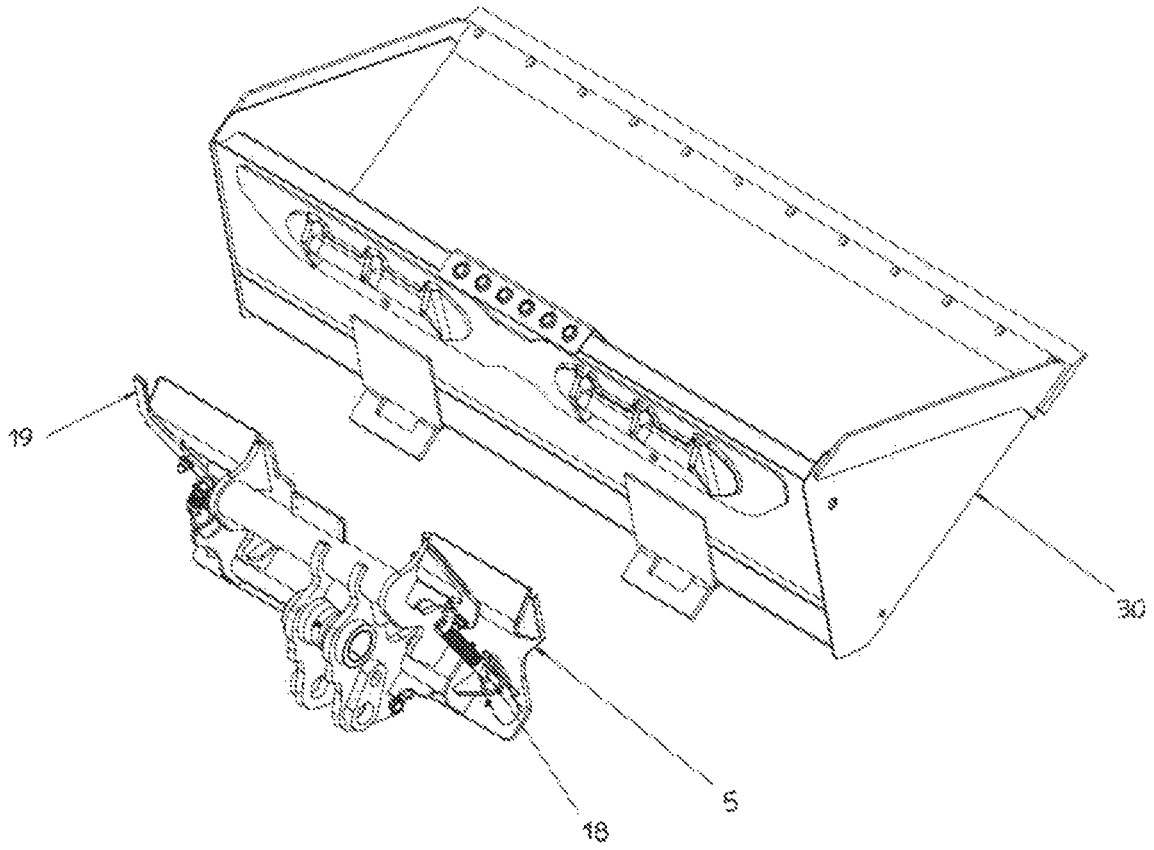
FIG. 7 shows a perspective view of a coupler in the course of being coupled to an accessory.
Figure 8:
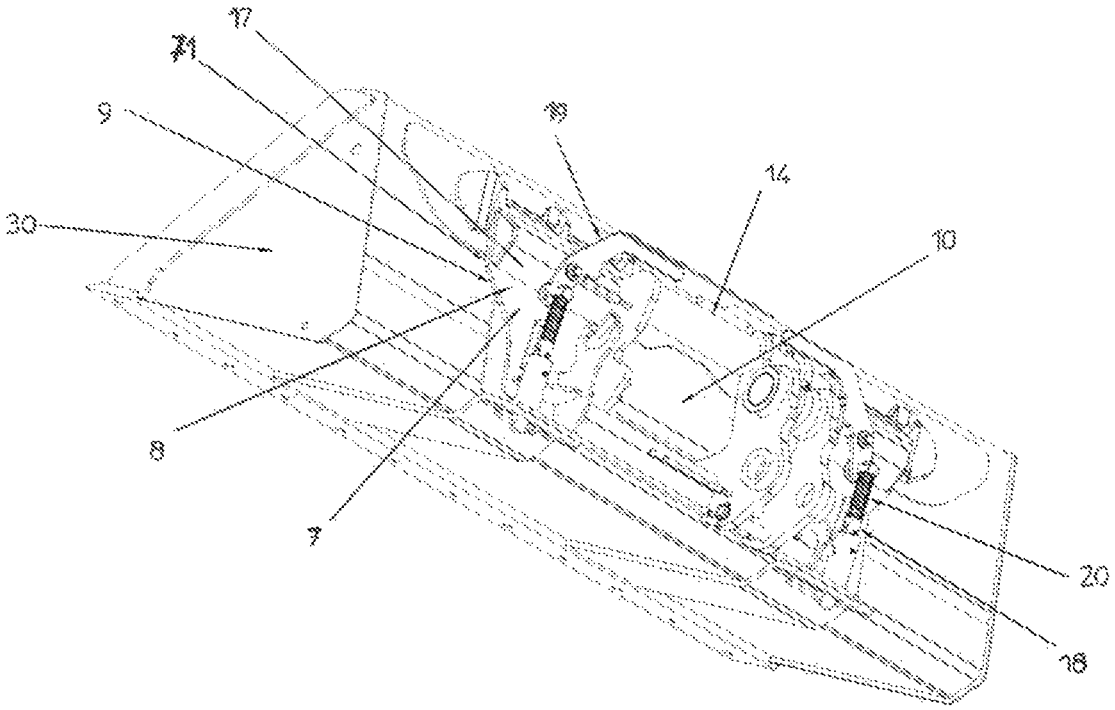
FIG. 8 shows a perspective view of the coupler of FIG. 7 in the state in which it is coupled to an accessory.

This ram 22 is arranged on the bottom face side of the arm 3. Thus, the extension of the ram 22 by removing the stem of the ram 22 drives an upwardly pivoting displacement of the plate 7, while a retraction of the ram 22 by inserting the stem of the ram 22 drives a downwardly pivoting displacement of the plate 7, as is illustrated in FIG. 4. The plate 7 is thus able to occupy an upright position in which it extends in a vertical plane.

This plate 7 which is delimited by edges 71 may be provided, along one or two of its edges, referred to as horizontal edges, which extend parallel to the pivot axis of the pivot connection 6 connecting the coupler 5 to the arm 3, with flanges for reinforcing said plate 7.

The plate 7 is provided with a through-opening 10 and that part 61 of the pivot connection 6 that is arranged on the rear face side of the plate 7 and that makes it possible to connect the coupler 5 to the arm 3 is arranged facing said opening 10. In the example shown, the plate 7 has, in the upright state, the overall shape of a U. The space left free between the branches 15 of the U forms said through-opening 10. This through-opening 10 delimited by edges shown by 11, 12, 13 in the figures is an opening referred to as being upwardly open in the upright state of the plate 7.

One of the delimiting edges of said opening 10 forming the upper edge 11 of said opening in the upright state of the plate 7 is therefore an open edge. The lower edge 12 of the opening 10 is formed by a part of the core 16 of the U. Thus, the through-opening 10 in the coupler 5 is an opening extending centrally between two opposite edges 71 of said plate 7, these opposite edges 71 of said plate 7 forming the vertical edges of said plate in the upright state of said plate. That part 61 of said pivot connection 6 connecting the coupler 5 to the arm 3 with which the rear face 8 of the plate 7 is equipped and which is arranged facing said opening 10 forms a one-piece assembly with said plate 7. This part 61 of said pivot connection 6 connecting the coupler 5 to the arm 3 with which the rear face 8 of the plate 7 is equipped and which is arranged facing said opening 10 is in the form of a sleeve delimiting a through-passage.

That part of the pivot connection 6 that is borne by the arm 3 is formed by two through-passages, each of which can be positioned at one end of the sleeve before a pin is inserted in the assembly thus formed.

In the examples shown, that part 61 of the pivot connection 6 connecting the coupler 5 to the arm 3 that is in the form of a sleeve is kept secured to the plate 7 by two parallel flanges through which said sleeve passes. These two flanges are fixed to the lower edge 12 of the through-opening 10 in the plate 7 and to a reinforcing element 14 which will be described below.

This arrangement results in reduced bulk of the opening 10 and of the pivot connection 6 connecting the coupler 5 to the arm 3 without adversely affecting the option for the accessory 30 to partially protrude through said opening 10 when the bulk of the accessory 30 necessitates such mounting.

To avoid any deformation of the plate 7 under the effect of the weight of the accessory 30 and possibly of a load, the coupler 5 is provided with a reinforcing element 14 extending from the rear face side 8 of the plate 7. This reinforcing element 14, which comprises a tubular element having a circular section, connects the branches of the U to one another at the free end of the branches of the U. This reinforcing element 14 therefore forms a bridge connecting the branches of the U to one another at the free end of the branches of the U. The tubular element of this reinforcing element 14 is formed by a profile attached and welded to said plate via two end flanges connecting the profile to the back, or rear face, of the plate 7. Each end flange 24 bearing by way of its edge against the rear face of the plate 7 is interposed between two gusset plates 25 arranged on either side of the flange and coupling the flange to the rear face of the plate 7. The tubular element of the reinforcing element 14 therefore extends away from the plate 7 in the state in which it is fixed to said plate 7 so as to keep the through-opening 10 in the plate 7 as free as possible.

To allow a connection between the coupler 5 and an accessory 30, the plate 7 is provided, on the rear face side, with two aligned profiles 17. These profiles 17 extend parallel to the pivot axis of the pivot connection 6 connecting the coupler 5 to the arm 3 on either side of said through-opening 10 in the coupler 5. These profiles 17 may each be formed by an L-shaped bracket applied to the rear face of the plate. The rear face of the plate closes the L of each of the profiles 17. The two profiles 17 are arranged at the free ends of the branches 15 of the U of the plate 7.

The accessory 30 may have recessed parts intended to cover these profiles 17. This results in an interlocking connection between the coupler and the accessory. To lock this interlocking connection, the coupler 5 comprises, on the rear face side 8 of the plate 7, two locking pins 18, preferably parallel in this instance. These locking pins 18 extend transversely, preferably orthogonally, to the axis of the pivot connection 6 connecting the coupler 5 to the arm 3. These locking pins 18 are each equipped with a handle 19 for driving the locking pin 18 in translation so as to displace said locking pin 18 between an unlocked position and a locked position and with a spring 20 for returning said locking pin 18 at least to the locked position.

In this way, in practice, the coupler 5 and an accessory 30 are mounted at the end of the arm 3 as follows: the coupler 5 is placed on the ground and rests with the front face 9 of the plate 7 against the ground. The arm 3 is moved closer to the rear face 8 of the plate 7 to make it possible, by means of attached pin ends, to pivotably couple the ram 22 and the arm 3 to the plate 7. Bushings or circlips may be used to keep a first pin end in aligned housings in the arm and in the coupler and to keep a second pin end in aligned housings in the ram and in the coupler. On each occasion, these aligned housings delimit a pin passage in a manner known per se so as to produce a pivot connection. At this juncture, the pivot connection 6 between the arm and the coupler has been described in detail above.

Once the coupler 5 has been fixed to the arm 3 and to the ram 22 of the machine 1, the accessory 30 is coupled to the coupler 5. Before coupling, the accessory rests on the ground and the handles 19 for actuating the locking pins 18 of the coupler 5 are in the unlocked position of the locking pins 18.

The arm and the coupler are driven in displacement as far as a position in which the coupler bears, by way of the front face 9 of its plate 7, against a bearing surface of the accessory 30, and the profiles 17 of the coupler are inserted from below in the recessed parts of the accessory 30, the opening of these recessed parts facing the ground.

Once the interlocking has been done, the position is locked by actuating the handles 19 for operating the locking pins 18, the free ends of which can be inserted in the housings in the accessory. Once this mounting is complete, the accessory 30 can protrude to a greater or lesser extent through the through-opening 10 in the plate 7 toward the arm 3.

The machine 1 is ready to work. The coupler and the accessory are dismounted in reverse, firstly with the accessory being dismounted from the coupler then, secondly, the coupler being dismounted from the arm.

The invention claimed is:

1. A working machine comprising:

a movable frame which can be displaced on the ground surface, a lifting arm mounted on the frame so as to be able to pivot about an axis, referred to as horizontal axis, for an upward and downward displacement of the arm, and an accessory coupler which can be secured to the free end of the arm by way of a pivot connection having an axis parallel to the pivoting axis of the arm relative to the frame, wherein said coupler, comprising a plate provided with a through-opening, the plate in the upright state having the overall shape of a U, the space left free between upwardly extending branches of the U forming said through-opening, wherein the plate has a face, referred to as rear face that faces the arm and is equipped with at least a part of said pivot connection connecting the coupler to the arm, and an opposite face, referred to as front face, wherein at least part of said pivot connection that connects the coupler to the arm with which the rear face of the plate is equipped, is arranged facing and within said free space between top portions of said upwardly extending opening between the branches of the U of the plate, and wherein the coupler is provided with a reinforcing element extending from the rear face side of the plate and in that the reinforcing element, which comprises a tubular element, connects the branches of the U to one another, at the free end of the branches of the U and contacts said pivot connection, wherein the reinforcing element is set back from the through-opening and connected to said rear face of said plate between two opposing gusseted end flanges one each on either of said branches of said U of said plate, said two opposing end flanges having two gussets each, one on either side thereof, and wherein the pivot connection is in the form of a sleeve secured to said plate by said two opposing end flanges.

2. The working machine as claimed in claim 1, wherein said through-opening, delimited by edges, is an opening referred to as being upwardly open in the upright state of the plate, one of the delimiting edges of said opening forming the upper edge of said opening in the upright state of the plate being an open edge.

3. The working machine as claimed in claim 1, wherein the tubular element of the reinforcing element has a circular section.

4. The working machine as claimed in claim 1, wherein the plate is provided, on the rear face side, with two aligned profiles, said profiles extending parallel to the pivot axis of the pivot connection connecting the coupler to the arm, on either side of said through-opening in the coupler.

5. The working machine as claimed in claim 4, wherein each profile is an L-shaped bracket applied to the rear face of the plate.

6. The working machine as claimed in claim 1, wherein the coupler comprises, for the purpose of coupling an accessory to the coupler, on the rear face side of the plate, two locking pins extending transversely to the axis of the pivot connection connecting the coupler to the arm, each of said locking pins being equipped with a handle for driving said locking pin in translation so as to displace said locking pin between an unlocked position and a locked position and with a spring for returning said locking pin to the locked position.

7. The working machine as claimed in claim 1, wherein the plate of the coupler is delimited by edges and in that the through-opening in the coupler is an opening extending centrally between two opposite edges of said plate.

8. The working machine as claimed in claim 1, wherein that part of said pivot connection connecting the coupler to the arm with which the rear face of the plate is equipped and which is arranged facing said opening forms a one-piece assembly with said plate.

9. The working machine as claimed in claim 1, wherein that part of said pivot connection connecting the coupler to the arm with which the rear face of the plate is equipped and which is arranged facing said opening is in the form of a sleeve delimiting a through-passage.

10. The working machine as claimed in claim 1, wherein the arm is provided with a ram which can be coupled to the coupler, on the rear face side of the plate of the coupler, by way of a pivoting connection having an axis parallel to the axis of the pivot connection connecting the arm to the coupler for the purpose of driving the plate in rotation about the pivot axis of the pivot connection connecting the coupler to the arm in the actuated state of said ram.

11. An assembly comprising:

a working machine and an accessory, wherein the working machine is in accordance with claim 1.

* * * * *